US008957933B2

(12) United States Patent
Shirasaki et al.

(10) Patent No.: US 8,957,933 B2
(45) Date of Patent: Feb. 17, 2015

(54) OPTICAL WRITING DEVICE, IMAGE FORMING APPARATUS, AND CONTROL METHOD OF OPTICAL WRITING DEVICE

(71) Applicants: Yoshinori Shirasaki, Osaka (JP); Tatsuya Miyadera, Kanagawa (JP); Masayuki Hayashi, Osaka (JP); Motohiro Kawanabe, Osaka (JP); Hiroaki Ikeda, Osaka (JP); Tomohiro Ohshima, Osaka (JP); Akinori Yamaguchi, Osaka (JP)

(72) Inventors: Yoshinori Shirasaki, Osaka (JP); Tatsuya Miyadera, Kanagawa (JP); Masayuki Hayashi, Osaka (JP); Motohiro Kawanabe, Osaka (JP); Hiroaki Ikeda, Osaka (JP); Tomohiro Ohshima, Osaka (JP); Akinori Yamaguchi, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/960,165

(22) Filed: Aug. 6, 2013

(65) Prior Publication Data

US 2014/0049591 A1 Feb. 20, 2014

(30) Foreign Application Priority Data

Aug. 15, 2012 (JP) ..... 2012-180115

(51) Int. Cl.

| | |
|---|---|
| ***B41J 2/435*** | (2006.01) |
| ***B41J 2/47*** | (2006.01) |
| ***B41J 2/385*** | (2006.01) |
| ***G03G 15/00*** | (2006.01) |

(52) U.S. Cl.

CPC ..... *G03G 15/80* (2013.01); *G03G 15/5004* (2013.01)

USPC ..... 347/237; 347/247; 347/224; 347/111; 347/118; 347/130

(58) Field of Classification Search

USPC ..... 347/237, 247, 118, 111, 224, 130

See application file for complete search history.

(56) References Cited

U.S. PATENT DOCUMENTS

| | | | | |
|---|---|---|---|---|
| 6,753,897 | B2 | 6/2004 | Vazan | |
| 2007/0147868 | A1 * | 6/2007 | Miyashita | 399/75 |
| 2008/0231878 | A1 * | 9/2008 | Yano et al. | 358/1.13 |
| 2013/0044176 | A1 * | 2/2013 | Shirasaki et al. | 347/118 |

FOREIGN PATENT DOCUMENTS

| | | |
|---|---|---|
| JP | 2002-354793 | 12/2002 |
| JP | 2003-220728 | 8/2003 |
| JP | 2011-046138 | 3/2011 |

* cited by examiner

*Primary Examiner* — Sarah Al Hashimi

(74) *Attorney, Agent, or Firm* — Harness, Dickey & Pierce, P.L.C.

(57) ABSTRACT

An optical writing device forming an electrical latent image on a photoreceptor includes an optical writing unit configured to apply light to the photoreceptor, a power supply unit configured to supply power to the optical writing unit, a power supply status detector configured to detect a power supply status of the power supplied from the power supply unit to the optical writing unit, and output power supply information or power cutoff information, a power cutoff information retaining unit configured to retain the power cutoff information when the power cutoff information is output from the power supply status detector, and a power sensor configured to sense a power supply status of the power supplied by the power supply unit based on the power cutoff information retained by the power cutoff information retaining unit.

10 Claims, 6 Drawing Sheets

OPTICAL WRITING DEVICE, IMAGE FORMING APPARATUS, AND CONTROL METHOD OF OPTICAL WRITING DEVICE

BACKGROUND OF THE INVENTION

1. Field of the Invention

The disclosures discussed herein related to an optical writing device, an image forming apparatus, and a control method of the optical writing device.

2. Description of the Related Art

There is an electrophotographic image forming apparatus including a light emitting diode array (hereinafter called "LEDA") for forming an electrostatic latent image on a photoreceptor as an optical writing unit. However, when the LEDA is used, the electrostatic latent image will not be formed uniformly due to inconsistent light intensity of each of LED elements, which may degrade the image quality.

Hence, there is disclosed a technology to prevent such degradation of the image quality due to the inconsistent light intensity. For example, Japanese Laid-open Patent Publication No. 2003-220728 (hereinafter referred to as "Patent Document 1") discloses a technology in which the light intensity of each of the LED elements is measured, correction data are created based on the measured light intensity of each of the LED elements, and each of the LED elements is driven based on a corresponding one of the corrected data so as to prevent the degradation of the image quality due to the inconsistent light intensity.

In the above technology disclosed in Patent Document 1, a central processing unit (CPU) controlling the LEDA transfers the correction data from memory to an LED driver, which then controls each of the LED elements based on a corresponding one of the correction data. Note that when the power supplied from a power source to the LEDA is instantaneously cut off (hereinafter also called "instantaneous cutoff"), the LED driver is initialized. Hence, it may be necessary to transfer the correction data to the LED driver again.

However, in a case where the instantaneous cutoff has occurred, for example, within a polling period of the CPU that controls the LEDA, the cutoff of the power supply to the LEDA will not be detected. Accordingly, when the instantaneous cutoff occurs immediately after the startup of the apparatus, the electrostatic latent image is formed in a state where the LED driver is initialized. Hence, the quality of the image formed may be degraded due to inconsistent light intensities of the LED elements.

RELATED ART DOCUMENT

Patent Document

Patent Document 1: Japanese Laid-open Patent Publication No. 2003-220728

SUMMARY OF THE INVENTION

Accordingly, it is a general object in one embodiment of the present invention to provide an optical writing device capable of detecting a power supply of an optical writing unit so as to constantly form a uniform electrostatic latent image.

According to one aspect of the embodiment, there is provided an optical writing device forming an electrical latent image on a photoreceptor. The optical writing device includes an optical writing unit configured to apply light to the photoreceptor; a power supply unit configured to supply power to the optical writing unit; a power supply status detector configured to detect a power supply status of the power supplied from the power supply unit to the optical writing unit, and output power supply information or power cutoff information; a power cutoff information retaining unit configured to retain the power cutoff information when the power cutoff information is output from the power supply status detector; and a power sensor configured to sense a power supply status of the power supplied by the power supply unit based on the power cutoff information retained by the power cutoff information retaining unit.

Additional objects and advantages of the embodiments will be set forth in part in the description which follows, and in part will be obvious from the description, or may be learned by practice of the invention.

It is to be understood that both the foregoing general description and the following detailed description are exemplary and explanatory only and are not restrictive of the invention as claimed.

Other objects and further features of the present invention will be apparent from the following detailed description when read in conjunction with the accompanying drawings.

DESCRIPTION OF THE PREFERRED EMBODIMENTS

Figure 1:
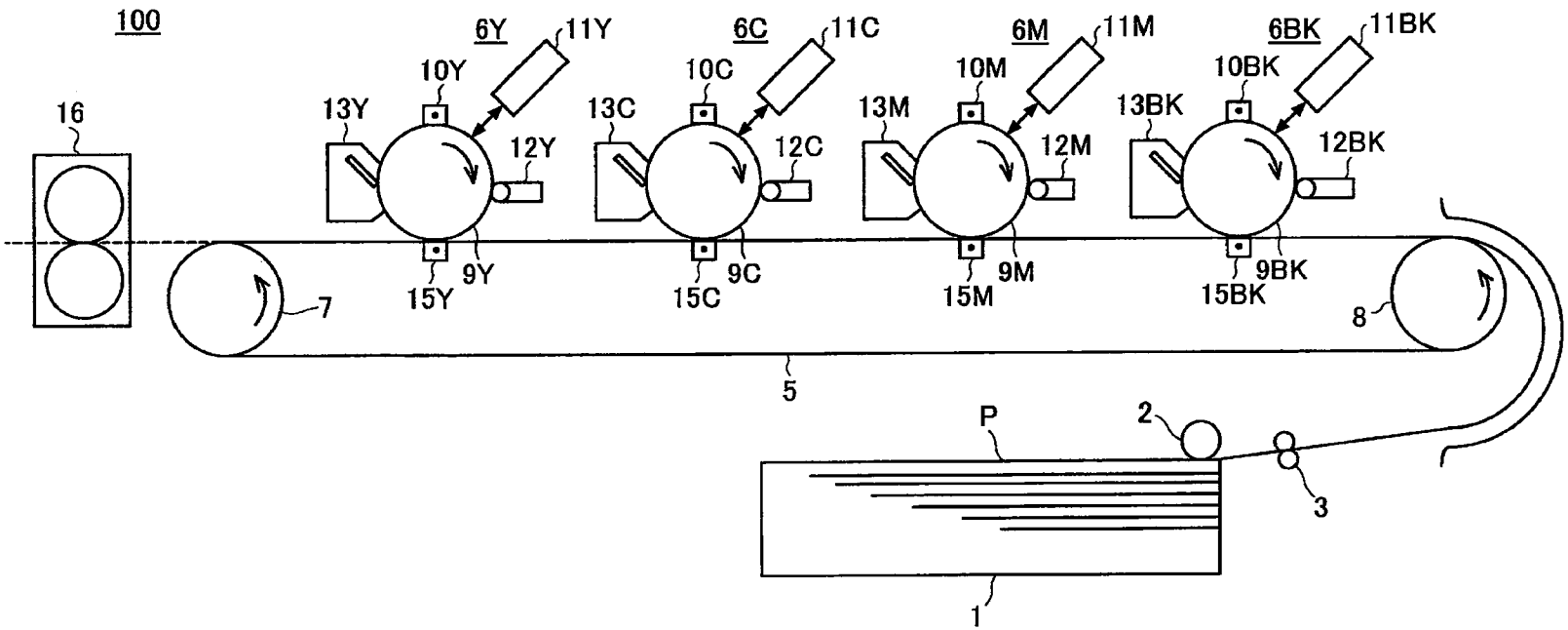
FIG. 1 is a schematic diagram illustrating a configuration example of an image forming apparatus according to an embodiment.

Preferred embodiments of the present invention will be described with reference to the accompanying drawings. In the drawings, identical components are designated by the same reference numerals, and duplicated descriptions thereof will be omitted.

Configuration of Image Forming Apparatus

Initially, a schematic configuration of an image forming apparatus according to an embodiment is described with reference to FIG. 1.

As illustrated in FIG. 1, an image forming apparatus 100 is a so-called "tandem image forming apparatus" having image forming units 6BK, 6M, 6C, and 6Y disposed in the order from upstream of a sheet P transfer direction along a transfer belt 5 configured to transfer the sheet P. The image forming units 6BK, 6M, 6C, and 6Y form a black image, a magenta image, a cyan image, and a yellow image, respectively.

In the following description, a configuration and operations of the image forming unit 6BK are specifically described; however, other image forming units 6M, 6C, and 6Y have configurations and operations similar to those of the image forming unit 6BK. Hence, the components of the image forming units 6M, 6C, and 6Y equivalent to those of the image forming unit 6BK are provided with M, C, and Y in place of BK, respectively, and the descriptions thereof are thus omitted.

When the image forming apparatus 100 starts an image forming process, a top one of the sheets P contained in a paper feed tray 1 is fed by a feed roller 2 and a separate roller 3, the fed sheet P is attracted to a transfer belt 5 by electrostatic attraction, and the sheet P attracted to the transfer belt 5 is transferred.

The transfer belt 5 is an endless belt looped over a driving roller 7 configured to rotationally drive by a not-illustrated drive motor, and a driven roller 8. Hence, the transfer belt 5 revolves according to the driving roller 7 to transfer the sheet P. When the sheet P is transferred by the transfer belt 5, a black toner image formed by the image forming unit 6BK based on image data is transferred onto the sheet P.

The image forming unit 6BK includes a photoreceptor drum 9BK, a charger 10BK, an LEDA 11BK, a developing device 12BK, a photoreceptor cleaner 13BK, and a not-illustrated static eliminator.

In the image forming unit 6BK, the charger 10BK initially charges a surface of the photoreceptor drum 9BK uniformly, and the LEDA 11BK exposes the photoreceptor drum 9BK to light corresponding to a black image to form an electrostatic latent image on the surface of the photoreceptor drum 9BK. When the photoreceptor drum 9BK rotates in a direction indicated by an arrow in FIG. 1, the electrostatic image is developed as a toner image by the developing device 12BK. The toner image rotates with the rotation of the photoreceptor drum 9BK and is then transferred onto the sheet P by a transfer device 15BK at a position (transfer position) in contact with the sheet P carried by the transfer belt 5.

The toner image is transferred from the surface of the photoreceptor drum 9BK on the sheet P, and residual toner is removed from the surface of the photoreceptor drum 9BK by a photoreceptor cleaner 13BK. The photoreceptor drum 9BK is then diselectrified by the not-illustrated static eliminator to be in a standby state for next image formation.

As described above, the sheet P now having the black toner image and having been transferred by the image forming unit 6BK is transferred by the transfer belt 5 to the image forming units 6M, 6C, and 6Y resides downstream of the transfer belt 5, where respective colors (i.e., magenta, cyan and yellow) of toner images are superimposed on the black toner image on the sheet P. Hence, the respective colors of toner images are superimposed on the black toner image to thereby form a full-color toner image on the surface of the sheet P.

The sheet P having the full-color toner image on its surface is then transferred to a fixing device 16, where the sheet P is heated and pressurized to fix the full-color toner image on the sheet P, and the sheet P now having the fixed full-color toner image is discharged from the image forming apparatus 100. The image forming apparatus 100 forms the image on the surface of the sheet P and outputs the sheet P having the image according to the above-described process.

Figure 2:
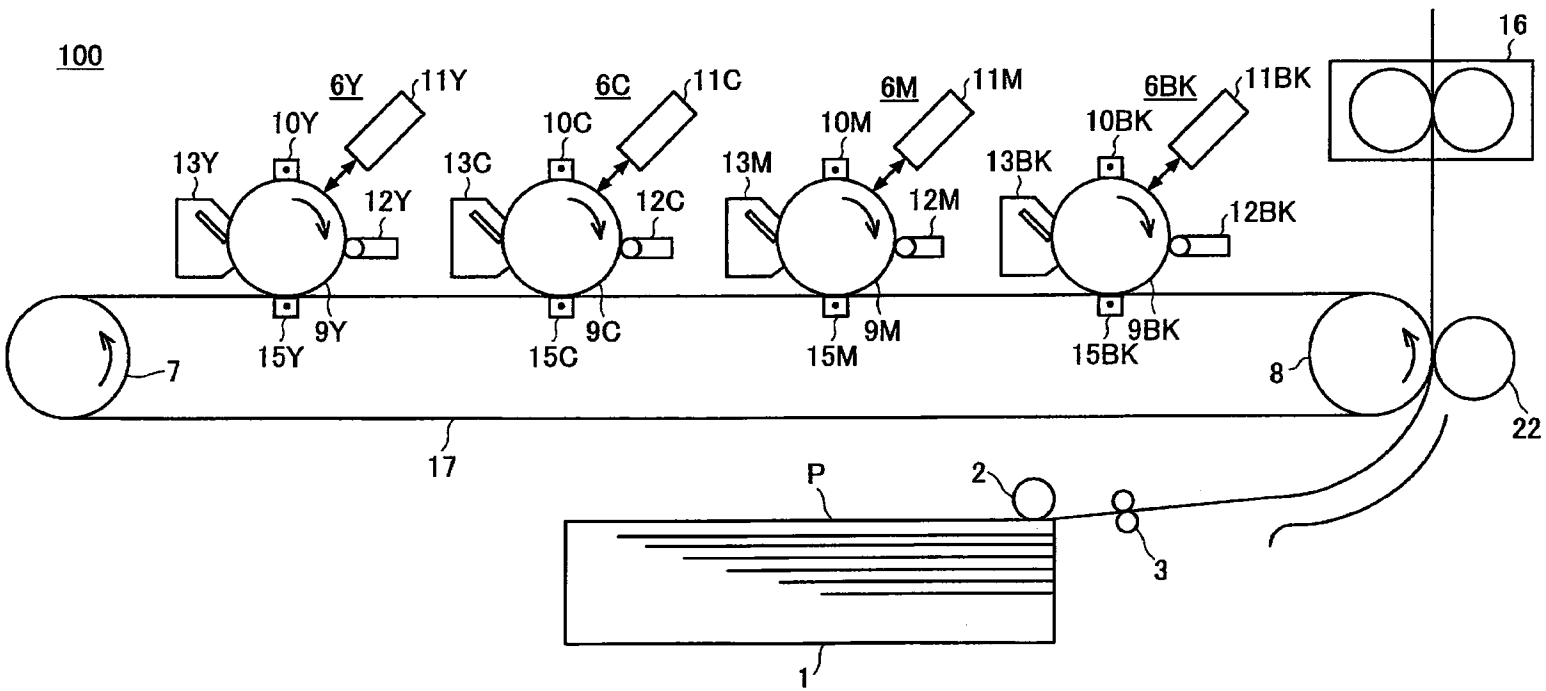
FIG. 2 is a schematic diagram illustrating another configuration example of an image forming apparatus according to an embodiment.

The image forming apparatus 100 may have a configuration exemplified in FIG. 2.

The image forming apparatus 100 exemplified in FIG. 2 includes an intermediate transfer belt 17, and causes the image forming units 6BK, 6M, 6C, and 6Y to superimpose respective toner images onto the intermediate transfer belt 17 to forma full-color toner image. The sheet P receives the toner image transferred from the intermediate transfer belt 17 between the intermediate transfer belt 17 and a secondary transfer roller 22, the toner image is fixed on the surface of the sheet P by the fixing device 16, and the sheet P having the fixed toner image is then discharged from the image forming apparatus 100.

As described above, the image forming apparatus 100 may have a configuration having the intermediate transfer belt 17 as illustrated in FIG. 2, or may have a revolver configuration having only one photoreceptor drum on which respective colors of toner images are formed. Alternatively, the image forming apparatus 100 may be a monochrome image forming apparatus configured to form a single color image.

Configuration of Optical Writing Device

Next, a description is given of a schematic configuration of an optical writing device 101 configured to form an electrostatic latent image on the surface of the photoreceptor drum 9 in the image forming apparatus 100 according to the embodiment.

Figure 3:
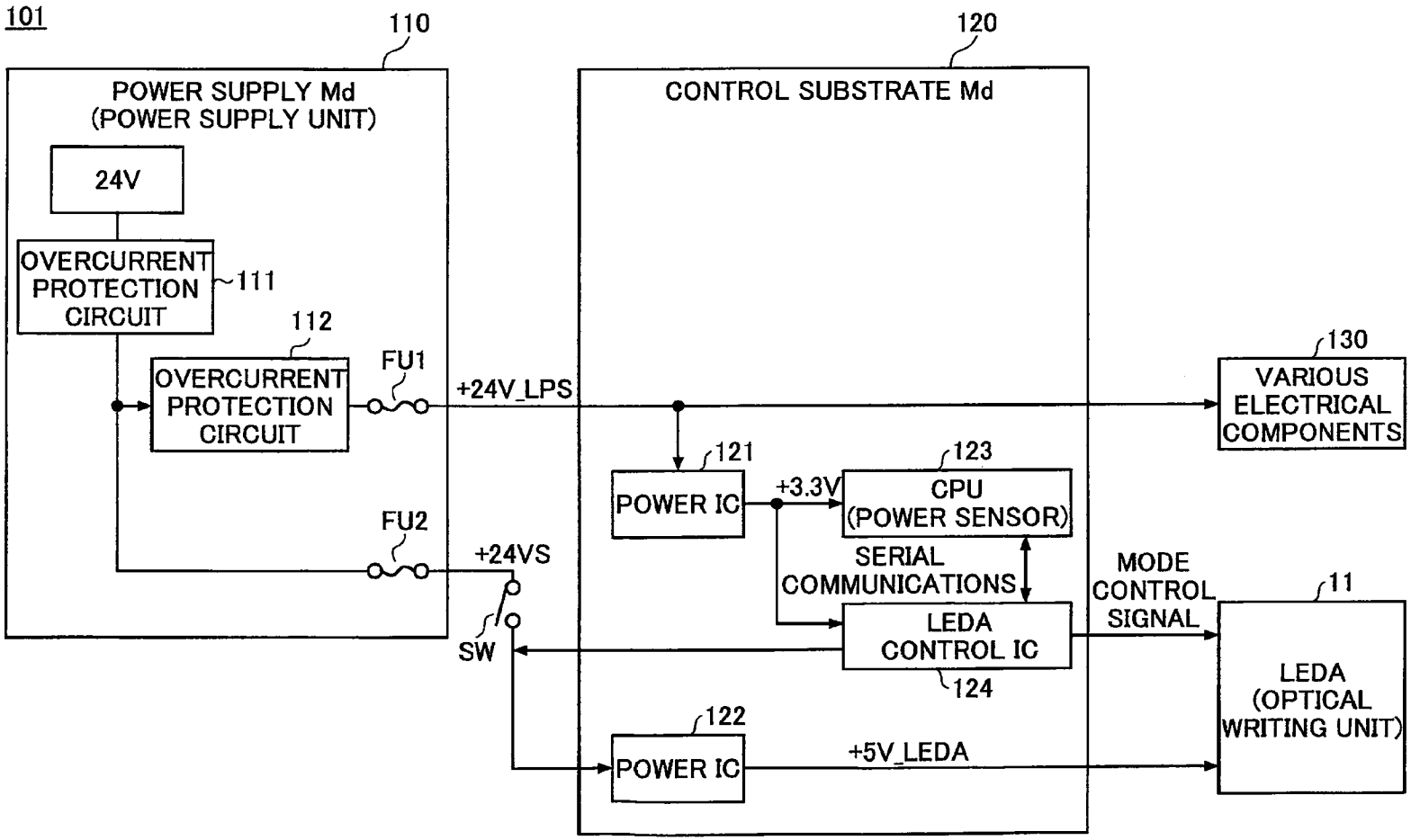
FIG. 3 is a schematic diagram illustrating a configuration example of a main part of an optical writing device according to an embodiment.

FIG. 3 is a schematic diagram illustrating a configuration example of a main part of an optical writing device 101 according to an embodiment.

The optical writing device 101 includes a control substrate Md 120, and an LEDA 11, and is configured to be driven by receiving the power from a power supply Md 110.

The power supply Md 110 may, for example, cause an AC/DC converter to convert commercial power into a DC 24V to supply power to the control substrate Md 120 and various electrical components 130. The power supply Md 110 includes overcurrent protection circuits 111 and 112, fuses FU1 and FU2 so as to prevent a load or the like from being damaged due to receiving an excessive electric current.

The control substrate Md 120 includes power ICs 121 and 122, a CPU 123, and an LEDA control IC 124.

The power ICs 121 and 122 may, for example, be a DC/DC converter configured to convert a voltage of the power supplied from the power supply Md 110. The power IC 121 may, for example, convert a voltage supplied from the power supply Md 110 into 3.3 V and supply the converted 3.3 V to the CPU 123 and the LEDA control IC 124. Further, the power IC 122 may, for example, convert a voltage supplied from the power supply Md 110 into 5 V and supply the converted 5 V to the LEDA 11.

The optical writing device 101 further includes an interlock switch SW between the power supply Md 110 and the control substrate Md 120. The interlock switch SW may, for example, be a switch configured to be switched ON or OFF simultaneously when opening or closing a cover of the optical writing device 101. The interlock switch SW is configured to be switched OFF when the cover of the optical writing device 101 is opened to cut off the power supplied to the control substrate Md 120, thereby preventing light applied from the LEDA 11 from leaking outside the image forming apparatus 100.

The CPU 123 may, for example, be an arithmetic unit configured to implement various functions of the optical writing device 101 by retrieving programs or data from not-illustrated storage devices such as HDD and ROM, and loading the retrieved programs and data in RAM to execute the loaded programs and data. The CPU 123 serves as a power sensor configured to sense a power supply status of the power supply Md 110.

The LEDA control IC 124 is controlled by the CPU 123 such that the LEDA control IC 124 transmits a mode control signal to the LEDA 11. The LEDA 11 includes, as operations modes, a "normal mode" in which writing operations are performed, and a "power-saving mode" in which power consumption is suppressed. The operations modes (i.e., the normal mode and the power-saving mode) are switched based on the mode control signal supplied from the LEDA control IC 124. Further, the LEDA control IC 124 may, for example, have a function to detect a power supply status of the LEDA 11 based on a power supply status of the power supplied from the power supply Md 110 to the power IC 122. Data are transmitted and received between the CPU 123 and the LEDA control IC 124 based on a serial communications system.

The LEDA 11 includes a plurality of LED elements disposed on a substrate member as light-emitting elements. The LEDA 11 is controlled by a not-illustrated LEDA driver such that the LEDA 11 exposes the surface of the photoreceptor drum 9 to light based on the image data input to the image forming apparatus 100. The LEDA driver controls the LEDA 11 such that inconsistent light intensity of each of the LED elements is corrected based on correction data created from the previously measured light intensity of each of the LED elements. The LEDA 11 may be able to form a uniform electrostatic latent image having no dot inconsistency on the photoreceptor drum 9 by controlling each of the LED elements based on the correction data to cause the LED elements to emit light.

Note that the LEDA driver may be able to control the LEDA 11 based on the correction data for forming subsequent electrostatic latent images by receiving the correction data at the startup of the optical writing device 101. However, when the power supplied to the LEDA 11 is instantaneously cut off after the startup, the LED driver is initialized. Hence, the LEDA driver is not capable of controlling the emission of each of the LED elements based on the correction data. Accordingly, in the optical writing device 101, the CPU 123 monitors the power supply status of the LEDA 11, and transmits the correction data to the LEDA driver again when the power supply is instantaneously cut off. Accordingly, the optical writing device 101 according to the embodiment is capable of forming a uniform electrostatic latent image by controlling each of the LED elements of the LEDA 11 based on the correction data even when the power supplied to the LEDA 11 is instantaneously cut off.

Method of Detecting Power Supply Status

Next, a description is given of a method of detecting a power supply status of the LEDA 11 in the optical writing device 101 according to the embodiment.

Figure 4:
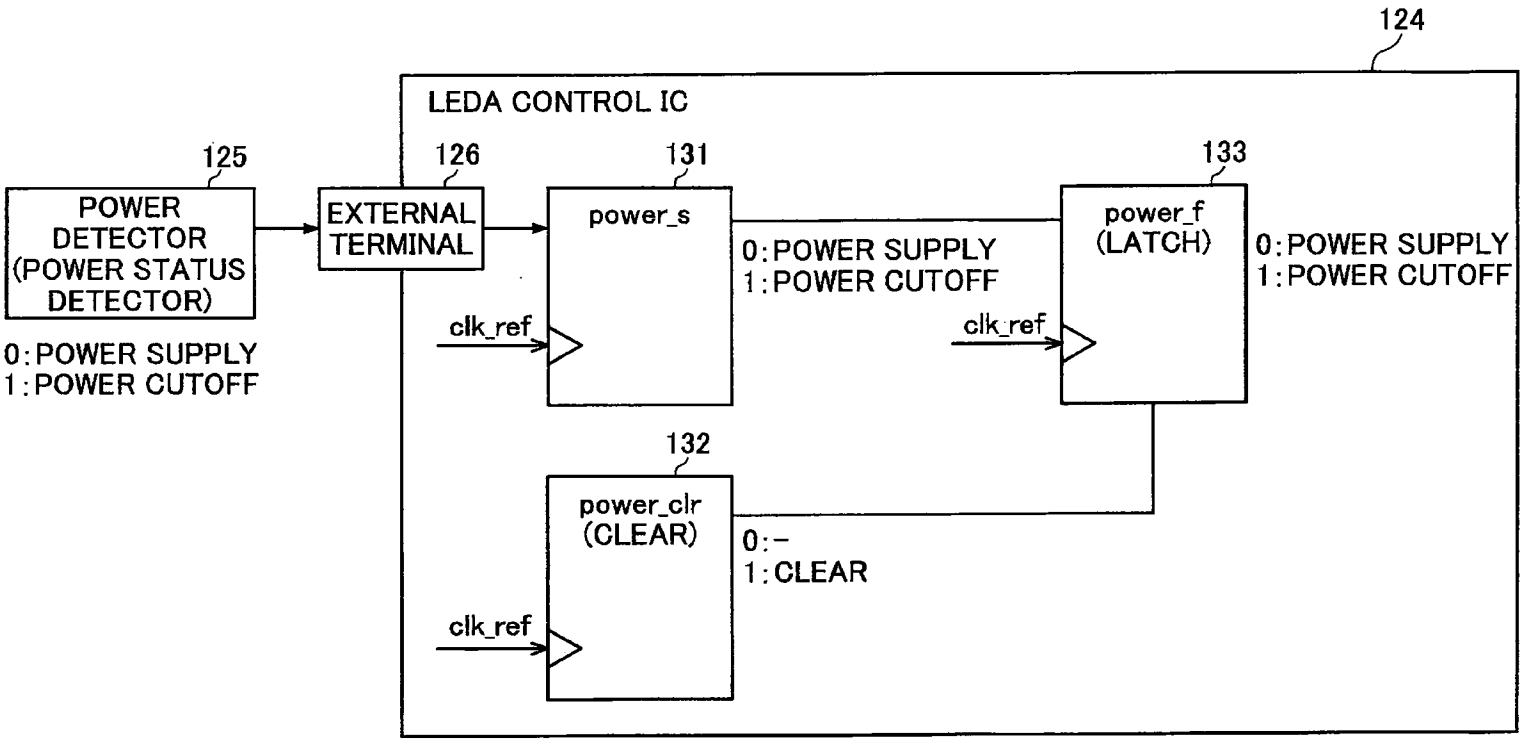
FIG. 4 is a schematic diagram illustrating a configuration example of an LEDA control IC according to an embodiment.

FIG. 4 is a schematic diagram illustrating a configuration example of an LEDA control IC 124 according to an embodiment.

A power detector 125 is configured to detect a power supply status of the power supplied from the power supply Md 110 to the power IC 122 of the control substrate Md 120, and transmit an output value of "0: power supply" or "1: power cutoff" to the LEDA control IC 124 based on the detected result. The power detector 125 may be an example of a power status detector.

The LEDA control IC 124 includes an external terminal 126, and flipflops 131, 132, and 133 (hereinafter simply referred to as "FF" or "FFs").

The external terminal 126 is connected to the control substrate Md 120 of the optical writing device 101, and configured to receive the output value of the power detector 125.

The FF 131 is an example of a power information retaining unit configured to retain one of the values of "0: power supply" and "1: power cutoff" (hereinafter called "power_s value") based on the output value output from the external terminal 126, and output the retaining value in synchronization with a clock period (clk_ref signal).

The FF 132 is configured to be written with one of the values "0: -" and "1: clear" (hereinafter called "power_clr value") by the CPU 123 disposed in the control substrate Md 120, and output the retaining value in synchronization with a clock period.

The FF 133 is configured to be supplied with signals output from the FF 131 and FF 132, and retain one of the values "0: power supply" and "1: power cutoff" (hereinafter called "power_f value").

When power is supplied from the power supply Md 110 to the power IC 122 of the control substrate Md 120, the output value of "0: power supply" is supplied to the external terminal 126 from the power detector 125, and the FF 131 retains the output value of "0: power supply" as a power_s value. Further, the FF 132 retains the value "0: -" written at the start up as the power_clr value. Hence, the FF 133 is supplied with the value "0" and retains the value "0: power supply" as the power_f value.

When the power supplied to the power IC 122 of the control substrate Md 120 from the power supply Md 110 is cut off, the output value of "1: power cut off" is supplied to the external terminal 126 from the power detector 125, and the FF 131 continuously retains the output value of "1: power cut off" as a power_s value. When the power is supplied to the control substrate Md 120 from the power supply Md 110 again, the CPU 123 writes "1: clear" as the power_clr value to allow the FF 133 to be returned in the initial state and to retain the value "0: power supply" as the power_f value.

Hence, when the power supplied from the power supply Md 110 is instantaneously cut off and the power is supplied to the control substrate Md 120 again, the FF 133 continuously retains the value "1: power supply" as the power_f value unless the CPU 123 writes "1: clear" as the power_clr value. Accordingly, in the optical writing device 101 according to the embodiment, it may be possible to detect the power supply status, that is, whether the power is stably supplied or the power is instantaneously cut off by causing the CPU 123 of the control substrate Md 120 to periodically read the power_f value of the FF 133.

Figure 5:
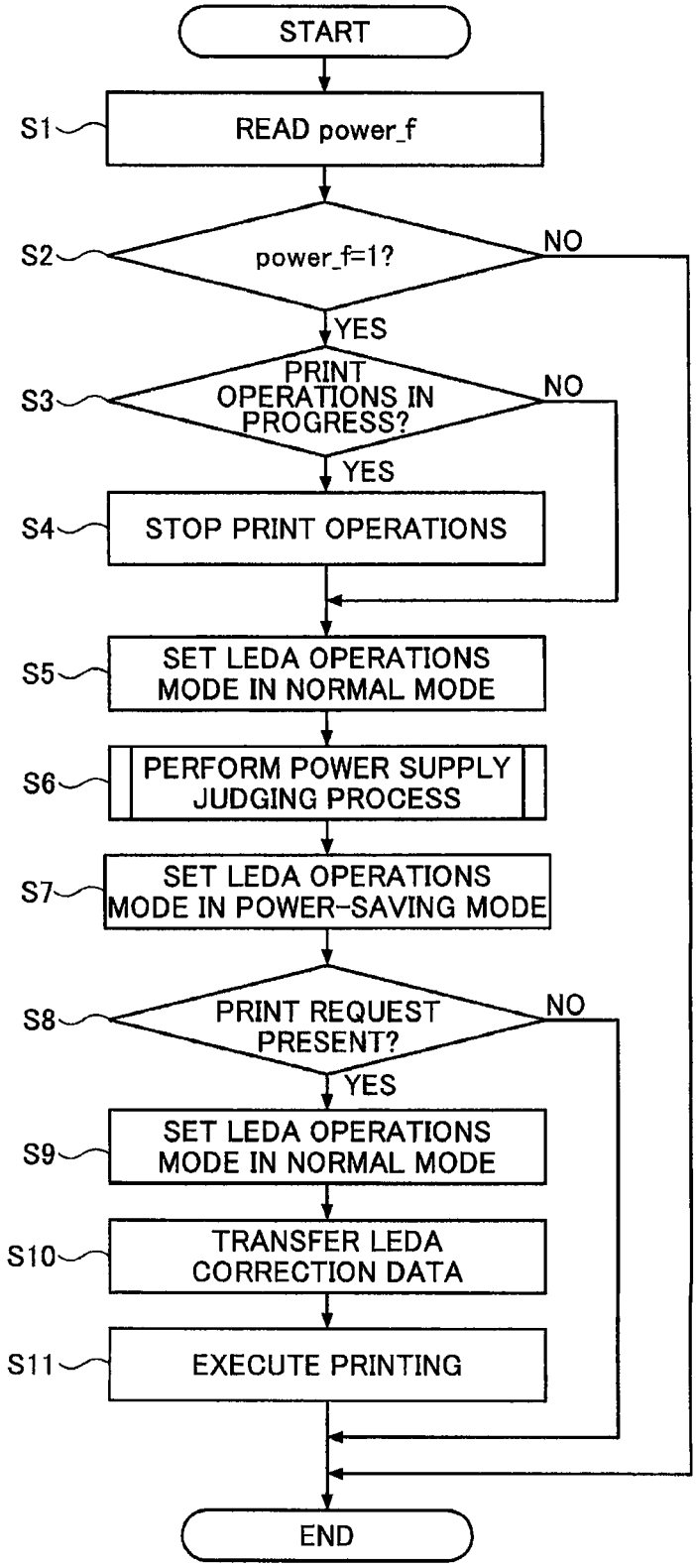
FIG. 5 is a diagram illustrating an example of a flowchart of a power supply status judging process in the optical writing device according to an embodiment.

FIG. 5 is a diagram illustrating an example of a flowchart of a power supply status judging process in the optical writing device 101 according to the embodiment.

The power supply status judging process is performed as follows. In step S1, the CPU 123 of the control substrate Md 120 reads a power_f value of the FF 133 of the LEDA control IC 124, and in step S2, when the read power_f value is "0: power supply" (i.e., "NO" in step S2), the power supply status judging process ends as it is.

When the read power_f value is "1: power cutoff" (i.e., "YES" in step S2), step S3 is processed to determine whether the print operations are in progress. When the print operations are in progress ("YES" in step S3), the print operations are stopped by terminating the exposure of the photoreceptor drum 9 to light by the LEDA 11 in step S4.

After the print operations are stopped in step S4, the CPU 123 sets respective operating modes of the LEDA 11 and the LEDA control IC 124 in a "normal mode" in step S5 so as to match the operating modes of the LEDA 11 and the LEDA control IC 124.

Figure 6:
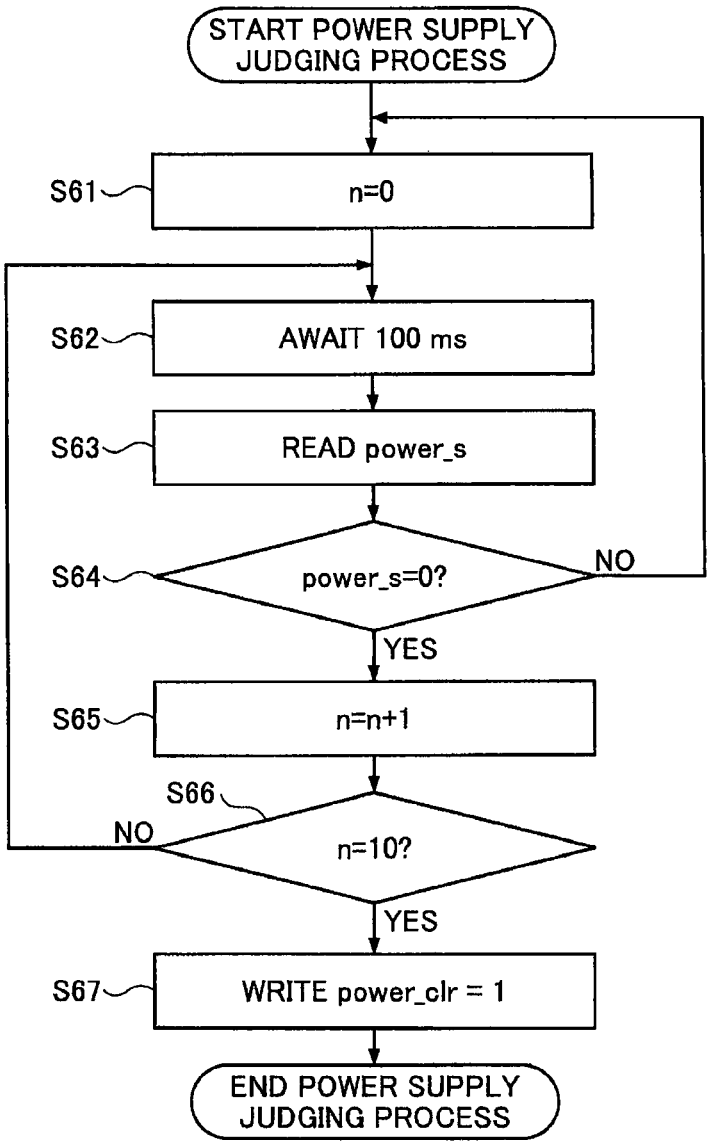
FIG. 6 is a diagram illustrating an example of a flowchart of a power supply judging process in the optical writing device according to an embodiment.

Next, a power supply judging process is performed to determine whether the power is normally supplied to the power IC 122 of the control substrate Md 120 from the power supply Md 110 in step S6. FIG. 6 is a diagram illustrating an example of a flowchart of a power supply judging process in the optical writing device 101 according to the embodiment.

The power supply judging process is performed as follows. In Step 61, a count value n=0 is set, 100 ms is awaited in step S62, and the power_s value of the FF 131 is read in step S63. Note that when the power is supplied from the power supply Md 110, the power_s value of the FF 131 of the LEDA control IC 124 is switched to "0: power supply" on the detection of the power supply by the power detector 125.

Then, whether the power_s value of the FF 131 of the LEDA control IC 124 is "0: power supply" is determined in step S64. When the power_s value is "0: power supply", the count value n is incremented by 1 in step S65. Processes in steps S62 to S65 are repeatedly carried out until the count value n=10 in step S66. When the power_s value is "1: power cutoff", processes from S61 are carried out again. Note that the number of times the processes from steps S62 to S65 are carried out may be one; however, the number of times the processes from are carried out may preferably be two or more. The power being supplied from the power supply Md 110 again may be more accurately determined by carrying out the processes from steps S62 to S65 two or more times.

When the count value n reaches 10 (i.e., n=10) in step S66, it is determined that the power is supplied from the power supply Md 110 again. Thereafter, "1: clear" is written as the power_clr value of the FF 132 to reset the FF 133 in the initial status, thereby ending the power supply judging process. When the power supply judging process ends, the power_s value of the FF 131 and the power_clr value of the FF 132 of the LEDA control IC 124 are "0: power supply" and "0: -", respectively. Hence, the FF 133 retains "0: power supply" as the power_f.

Next, referring back to FIG. 5, the operating mode of the LEDA 11 is set in the "power-saving mode" in step S7 so as to prevent unnecessary power from being consumed in the LEDA 11.

Subsequently, whether the print request is present is determined in step S8, and when the print request is not present ("NO" in step S8), the power supply status judging process ends as it is. When the print request is present ("YES" in step S8), the operating mode of the LEDA 11 is set in the "normal mode" in step S9, the CPU 123 transfers the correction data to the LEDA driver of the LEDA 11. The LEDA driver is initialized by causing the power supply to be cut off. However, the LEDA driver may be able to control each of the LED elements based on the correction data by receiving the correction data again after the power is supplied to the LEDA driver.

Thereafter, when the printing operations such as the exposure of the photoreceptor drum 9 to light are started in step S11, the power supply status judging process ends.

The CPU 123 of the control substrate Md 120 carries out the above-described process periodically (e.g., 100 ms intervals) to detect the instantaneous cutoff of the power supplied to the LEDA 11. Then, when the instantaneous cutoff of the power supplied to the LEDA 11 is detected, the correction data are retransferred to the LEDA driver. Accordingly, since each of the LED elements of the LEDA 11 is constantly controlled by the LEDA driver based on the correction data, the optical writing device 101 according to the embodiment is capable of stably forming a uniform electrostatic latent image on the photoreceptor drum 9. Further, the image forming apparatus 100 having the optical writing device 101 is capable of constantly and stably outputting images with a specific quality.

As described above, the optical writing device 101 according to the embodiment may be able to detect the power supply status of the power supplied to the LEDA 11 by reading the value retained by the FF 133 of the LEDA control IC 124. Accordingly, even when the power supplied to the LEDA 11 is instantaneously cut off, a uniform electrostatic latent image may continuously be formed by detecting the instantaneous power supply cutoff and retransfering the correction data to the LEDA driver. Further, the image forming apparatus 100 according to the embodiment is capable of constantly and stably outputting images having a specific quality or above without degrading the image quality due to inconsistent light intensity to which the photoreceptor drum 9 is exposed.

According to the embodiments, the optical writing device capable of detecting a power supply status of the power supplied to the optical writing unit to constantly form a uniform electrostatic latent image.

As described above, the embodiments of the optical writing device, the image forming apparatus and the control method of the optical writing device are illustrated. However, the present invention is not limited to the above-described embodiments. Various alternations and modifications may be made within a scope of the invention.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiment of the present invention has been described in detail, it should be understood that various changes, substitutions, and alterations could be made hereto without departing from the spirit and scope of the invention.

This application is based on and claims the benefit of priority of Japanese Patent Application No. 2012-180115, filed on Aug. 15, 2012, the entire contents of which are hereby incorporated herein by reference.

What is claimed is:

1. An optical writing device forming an electrical latent image on a photoreceptor, the optical writing device comprising:

an optical writing unit configured to apply light to the photoreceptor;

a power supply unit configured to supply power to the optical writing unit;

a power supply status detector configured to detect a power supply status of the power supplied from the power supply unit to the optical writing unit, and output power supply information or power cutoff information;

a power cutoff information retaining unit configured to retain the power cutoff information when the power cutoff information is output from the power supply status detector;

a power sensor configured to sense a power supply status of the power supplied by the power supply unit based on the power cutoff information retained by the power cutoff information retaining unit; and a power information retaining unit configured to retain the power supply information or the power cutoff information output from the power supply status detector, wherein the power sensor senses that power is supplied again by the power supply unit based on the power supply information retained by the power information retaining unit when the power sensor senses that the power supplied from the power supply unit is cut off based on the power cutoff information retained by the power cutoff information retaining unit.

2. The optical writing device as claimed in claim 1, wherein the power sensor senses that power is supplied again by the power supply unit when the power sensor periodically determines that the power information retaining unit retains the power supply information a plurality of times.

3. The optical writing device as claimed in claim 1, wherein the power sensor causes the power cutoff information retaining unit to retain the power supply information in place of the power cutoff information when the power sensor senses that power is supplied again by the power supply unit.

4. The optical writing device as claimed in claim 1, wherein the optical writing unit includes a light-emitting element array having a plurality of light-emitting elements disposed on a substrate member.

5. The optical writing device as claimed in claim 4, wherein the power sensor transmits correction data for correcting inconsistent light intensity of each of the light-emitting elements by controlling the light-emitting elements when the power sensor senses that power is supplied again by the power supply unit.

6. The optical writing device as claimed in claim 1, wherein the optical writing unit includes a plurality of operating modes including a power-saving mode, and the power sensor switches the operating mode of the optical writing unit to the power-saving mode when the power sensor senses that power is supplied again by the power supply unit.

7. An image forming apparatus comprising the optical writing device as claimed in claim 1.

8. A method of controlling an optical writing device forming an electrical latent image on a photoreceptor, the optical writing device including an optical writing unit configured to apply light to the photoreceptor, and a power supply unit configured to supply power to the optical writing unit, the method comprising:

detecting a power supply status of the power supplied from the power supply unit to the optical writing unit, and outputting power supply information or power cutoff information;

retaining the power cutoff information when the power cutoff information is output;

retaining the power supply information or the power cutoff information output from the power supply status detector; and sensing a power supply status of the power supplied by the power supply unit based on the retained power cutoff information, wherein the sensing senses that power is supplied again by the power supply unit based on the power supply information retained when the sensing senses that the power supplied from the power supply unit is cut off based on the power cutoff information retained by the power cutoff information retaining unit.

9. An optical writing device forming an electrical latent image on a photoreceptor, the optical writing device comprising:

an optical writing unit configured to apply light to the photoreceptor;

a power supply unit configured to supply power to the optical writing unit;

a power supply status detector configured to detect a power supply status of the power supplied from the power supply unit to the optical writing unit, and output power supply information or power cutoff information;

a power cutoff information retaining unit configured to retain the power cutoff information when the power cutoff information is output from the power supply status detector; and a power sensor configured to sense a power supply status of the power supplied by the power supply unit based on the power cutoff information retained by the power cutoff information retaining unit, wherein the power cutoff information indicates whether the power supplied from the power supply unit to the optical writing unit was previously cutoff, and the power sensor is configured to sense the power supply status of the power supplied by the power supply unit by periodically reading the power cutoff information retained by the power cutoff information retaining unit.

10. A method of controlling an optical writing device forming an electrical latent image on a photoreceptor, the optical writing device including an optical writing unit configured to apply light to the photoreceptor, and a power supply unit configured to supply power to the optical writing unit, the method comprising:

detecting a power supply status of the power supplied from the power supply unit to the optical writing unit, and outputting power supply information or power cutoff information;

retaining the power cutoff information when the power cutoff information is output; and sensing a power supply status of the power supplied by the power supply unit based on the retained power cutoff information, wherein the power cutoff information indicates whether the power supplied from the power supply unit to the optical writing unit was previously cutoff, and the sensing sense the power supply status of the power supplied by the power supply unit by periodically reading the retained power cutoff information.

* * * * *